US006599120B1

(12) United States Patent
Lin

(10) Patent No.: US 6,599,120 B1
(45) Date of Patent: Jul. 29, 2003

(54) IGNITER WITH SECURITY DEVICE

(76) Inventor: Hwai-Tay Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 0 days.

(21) Appl. No.: 10/269,550

(22) Filed: Oct. 11, 2002

(51) Int. Cl.[7] ..... F23D 11/36; F23Q 7/12
(52) U.S. Cl. ..... 431/153; 431/255
(58) Field of Search ..... 431/153, 255

(56) References Cited

U.S. PATENT DOCUMENTS 6,126,437 A * 10/2000 Lixiang et al. ..... 431/153
6,386,861 B1 * 5/2002 Sher ..... 431/153
6,439,879 B1 * 8/2002 Hsu ..... 431/153
6,468,070 B1 * 10/2002 Jon ..... 431/153
6,488,493 B2 * 12/2002 Sung ..... 431/153

* cited by examiner

*Primary Examiner*—Alfred Basichas
(74) *Attorney, Agent, or Firm*—Alan D. Kamrath; Rider Bennett, LLP.

(57) ABSTRACT

An igniter includes a shell, a generator, a button and a security device. The generator includes a cylinder received in the shell and a plunger extending from the cylinder and being movable toward the cylinder in order to generate a voltage. The button is attached to the plunger. The security device includes a lever. The lever is pivotally received in the shell and formed with a hook for hooking the button. The security device and the button are located that a user contacts the security device before the button during an operation of ignition. A gas torch includes a shell, a tank, a valve, a generator, a button and a security device. The tank is received in the shell for containing fuel. The valve is mounted on the tank and movable between a closing position for keeping the fuel in the tank and an opening position for allowing the fuel to vent from the tank. The generator includes a cylinder received in the shell and a plunger extending from the cylinder and being movable toward the cylinder in order to generate a voltage. The button is connected with the valve and the plunger. The security device includes a lever. The lever is pivotally received in the shell and formed with a hook for hooking the button. The security device and the button are located that a user contacts the security device before the button during an operation of ignition.

20 Claims, 6 Drawing Sheets

IGNITER WITH SECURITY DEVICE

BACKGROUND OF INVENTION

1. Field of Invention

The present invention relates to an igniter and, more particularly, to an igniter with a security device.

2. Related Prior Art

Taiwanese Patent Application No. 247615 discloses a conventional electronic igniter. This conventional electronic igniter includes a shell 1, a voltage generator 2 received in the shell 1, a lever 4 pivotally mounted on the shell 1 and a security element 6 movably mounted on the shell 1. The voltage generator 2 includes a button 20. The lever 4 is pivotally mounted on the shell 11 by means of a pin. The lever 4 includes a first end 41 in contact with the button 20. The security element 6 includes a sled 60 movably mounted on the shell 1. The sled 60 includes an end for contact a second end of the lever 4. The security element 6 can be moved& between a locking position and a releasing position. In the locking position, the end of the sled 60 contacts the second end of the lever 4 so that the lever 4 cannot be pivoted, i.e., the first end 41 of the lever 4 cannot push the button 20. Thus, a voltage cannot be produced via the voltage generator 2. In the releasing position, the end of the security element 60 is removed from the second end of the lever 4 so that the lever 4 can be pivoted. Thus, the first end 41 of the lever 4 can push the button 20. Thus, a voltage can be produced via the voltage generator 2. However, operation of the security element 6 and operation of the lever 4 cannot be connected smoothly.

The present invention is therefore intended to obviate or at least alleviate the problems encountered in prior art.

SUMMARY OF INVENTION

It is an objective of the present invention to provide an igniter with a security device that is effective and easily operable.

According to the present invention, an igniter includes a shell, a generator, a button and a security device. The generator includes a cylinder received in the shell and a plunger extending from the cylinder and being movable toward the cylinder in order to generate a voltage. The button is attached to the plunger. The security device includes a lever. The lever is pivotally received in the shell and formed with a hook for hooking the button. The security device and the button are located that a user contacts the security device before the button during an operation of ignition. It is the primary objective of the present invention to provide an igniter with a security device that is effective and easily operable.

It is another objective of the present invention to provide a gas torch with a security device that is effective and easily operable.

According to the present invention, a gas torch includes a shell, a tank, a valve, a generator, a button and a security device. The tank is received in the shell for containing fuel. The valve is mounted on the tank and movable between a closing position for keeping the fuel in the tank and an opening position for allowing the fuel to vent from the tank. The generator includes a cylinder received in the shell and a plunger extending from the cylinder and being movable toward the cylinder in order to generate a voltage. The button is connected with the valve and the plunger. The security device includes a lever. The lever is pivotally received in the shell and formed with a hook for hooking the button. The security device and the button are located that a user contacts the security device before the button during an operation of ignition.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
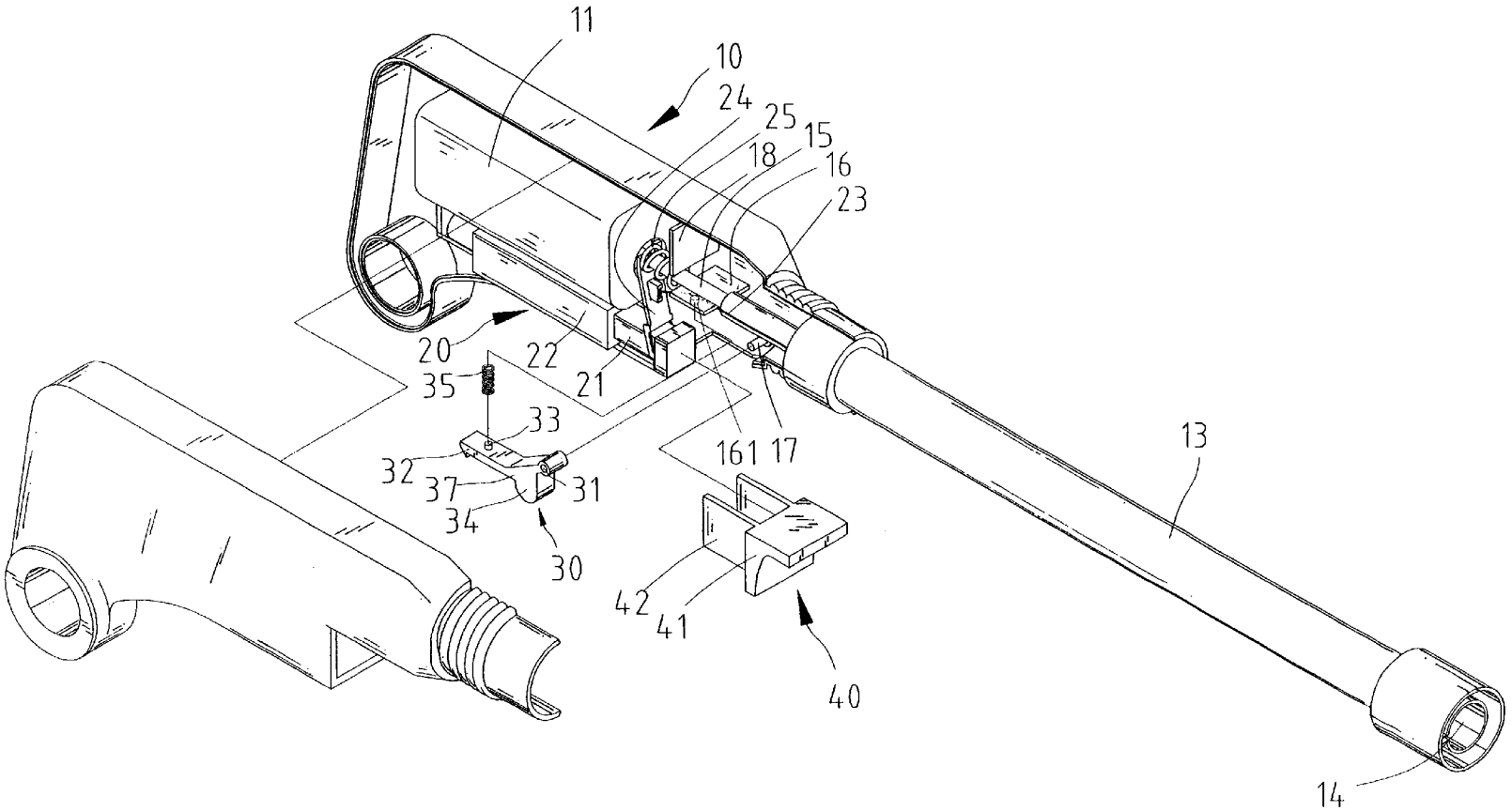
FIG. 1 is an exploded view of a gas torch according to a first embodiment of the present invention.
Figure 2:
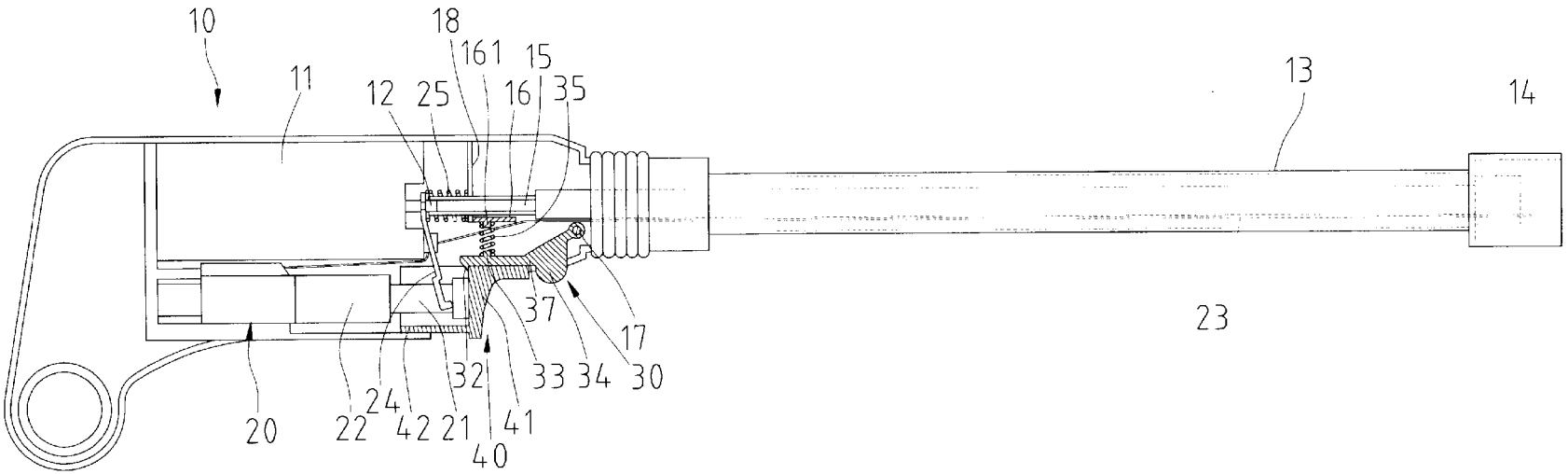
FIG. 2 is a cross-sectional view of the gas torch according to the first embodiment of the present invention.

Referring to FIGS. 1 and 2, according to a first embodiment of the present invention, a gas torch includes a shell 10, a voltage generator 20 received in the shell 10, a security device 30 pivotally mounted on the shell 10 and a button 40 movably mounted on the shell 10.

The shell 10 consists of first and second halves (not numbered) that can be assembled so as to form the shell 10. Only the first halve of the shell 10 is shown in detailed. A plate 16 is formed on an internal face of the first halve of the shell 10. A boss 161 is formed on a face of the plate 16. A pin 17 is formed on the internal face of the first halve of the shell 10. A plate 18 is formed on the internal face of the first halve of the shell 10.

A tank 11 is received in the shell 10 in order to contain fuel. A valve 12 is movably mounted on the tank 11. The valve 12 can be pulled from a closing position to an opening position. In the closing position, the valve 12 keeps fuel in the tank 11. In the opening position, the valve 12 allows fuel to vent from the tank 11. A spring 25 is compressed between the valve 12 and the plate 18 so as to bias the valve 12 to the closing position. A barrel 13 is mounted on the shell 10. A nozzle 14 is installed at an end of the barrel 13. A pipe 15 includes a first end in communication with the valve 12 and a second end in communication with the nozzle 14.

This voltage generator 20 includes a plunger 21 and a cylinder 22. The plunger 21 is movably mounted on a cylinder 22 received in the shell 10. The plunger 21 can be pushed toward the cylinder 22 so as to generate a voltage. The voltage generator 20 includes a first electrode connected with a wire 23 extending to a position near the nozzle 14 and a second electrode connected with the nozzle 14.

A seesaw 24 is pivotally installed in the shell 10. The seesaw 24 includes a first end in contact with the valve 12 and a second end in contact with the button 40.

The button 40 is movably mounted on the shell 10. The button 40 includes an external face for contact with a finger of a user and an internal face on which a sled 42 is formed. The sled 42 of the button 40 is inserted in the shell 10. The plunger 21 is inserted in the sled 42 of the button 40 so that the plunger 21 contacts the button 40.

The security device 30 includes a lever 37 and a spring 35. The lever 37 includes an end formed with a collar 31 in which the rod 17 is inserted and a second end formed with a hook 32 for hooking the button 40. The lever 37 includes a first face on which a boss 33 is formed and a second face on which an extension 34 is formed. A spring 35 is compressed between the plate 16 and the lever 37. The spring 35 includes an end in which the boss 161 is fit and an opposite end in which the boss 33 is fit.

Referring to FIG. 2, the button 40 is hooked via the hook 32. Thus, the button 40 cannot be pressed. That is, the plunger 21 cannot be pushed toward the cylinder 22. Therefore, a voltage cannot be produced.

Figure 3:
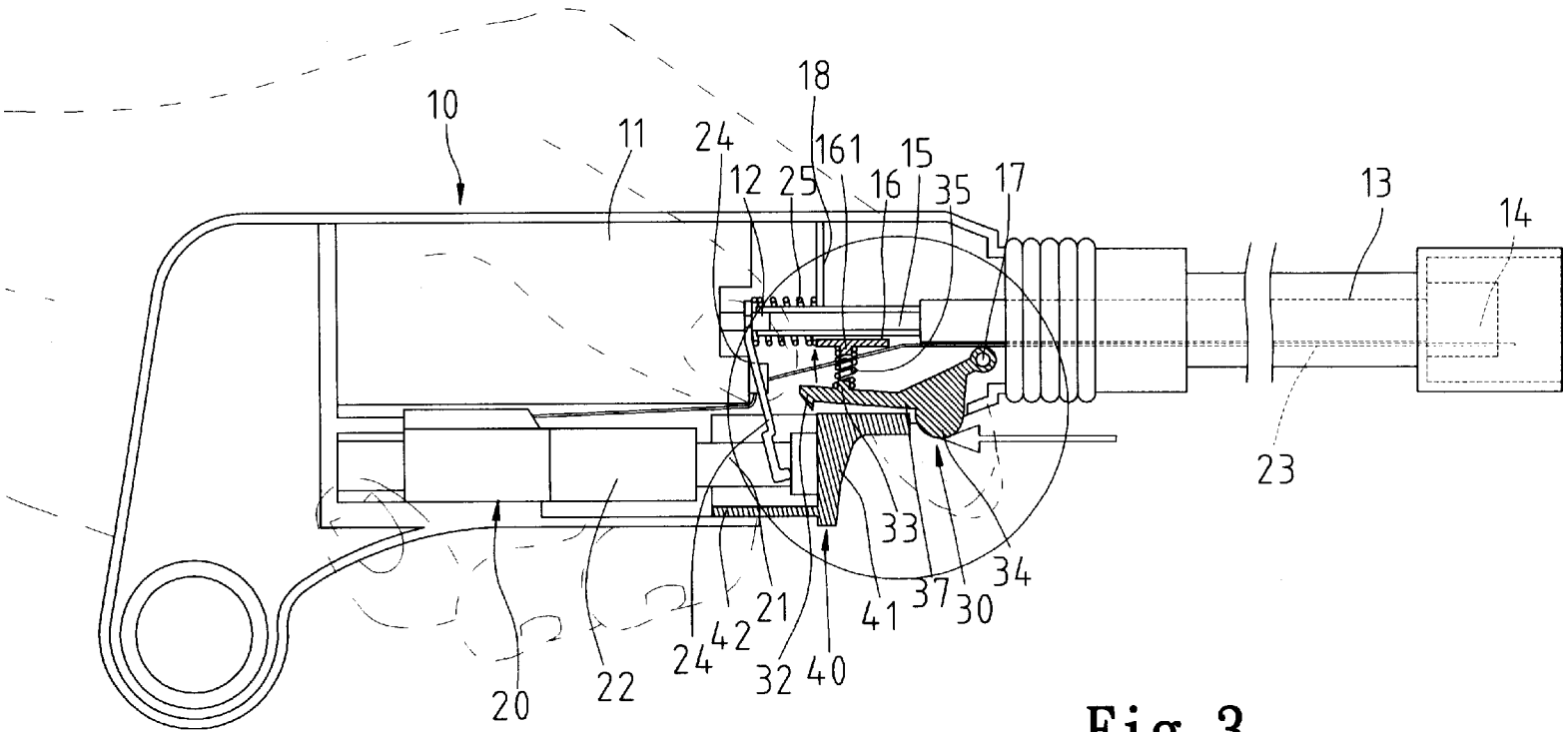
FIG. 3 is a cross-sectional view of the gas torch according to the first embodiment of the present invention.
Figure 4:
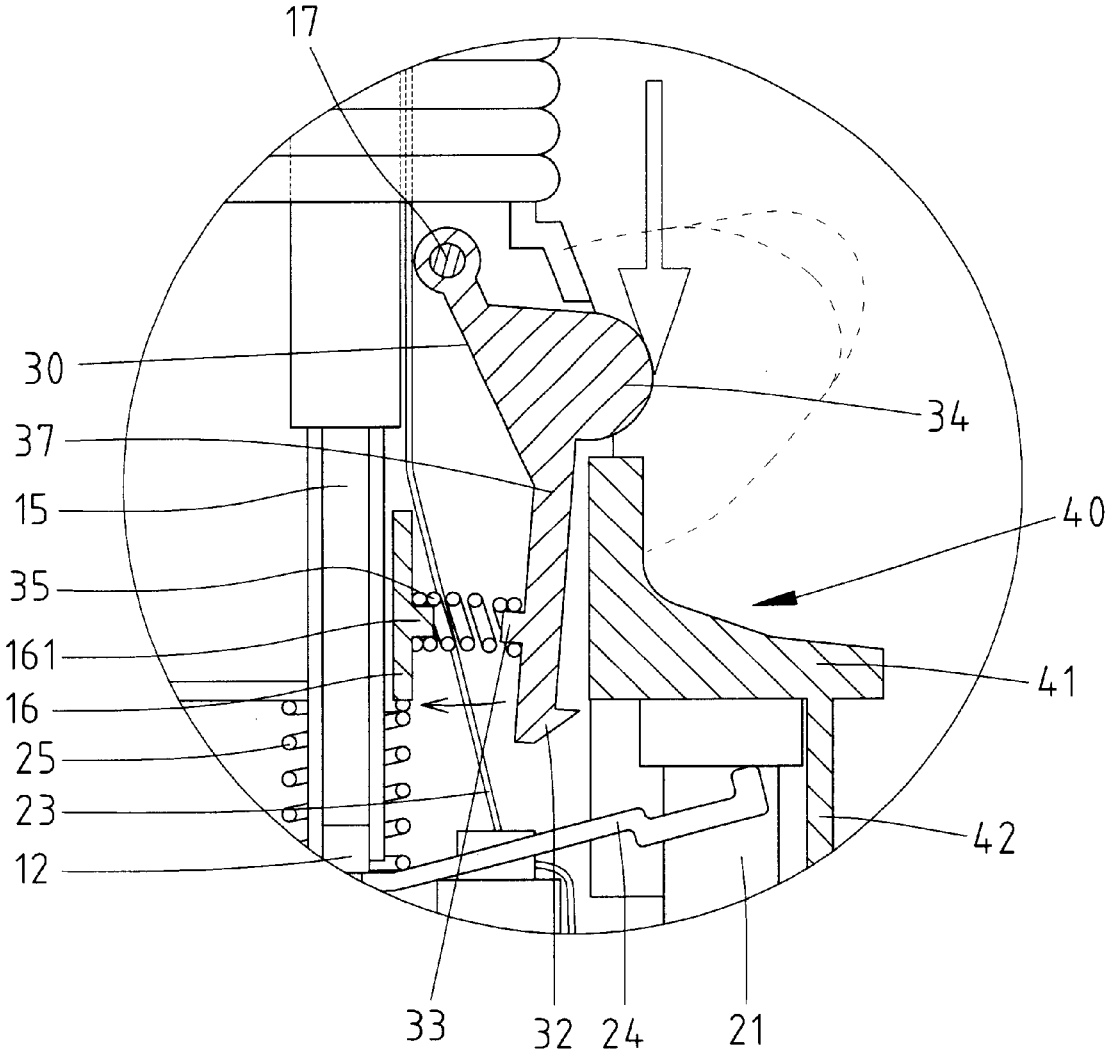
FIG. 4 is an enlarged cross-sectional view of a security device used in the gas torch according to the first embodiment of the present invention.

Referring to FIGS. 3 and 4, a user moves his or her finger in order to press the protrusion 34 so as to pivot the security device 30, thus removing the hook 32 from the button 40. Then, the user can move the finger smoothly from the protrusion 34 to the button 40. Thus, the user can move the finger to press the button 40. It can be readily recognized that the manipulation of the lever 37 and the manipulation of the button 40 can be connected smoothly.

Figure 5:
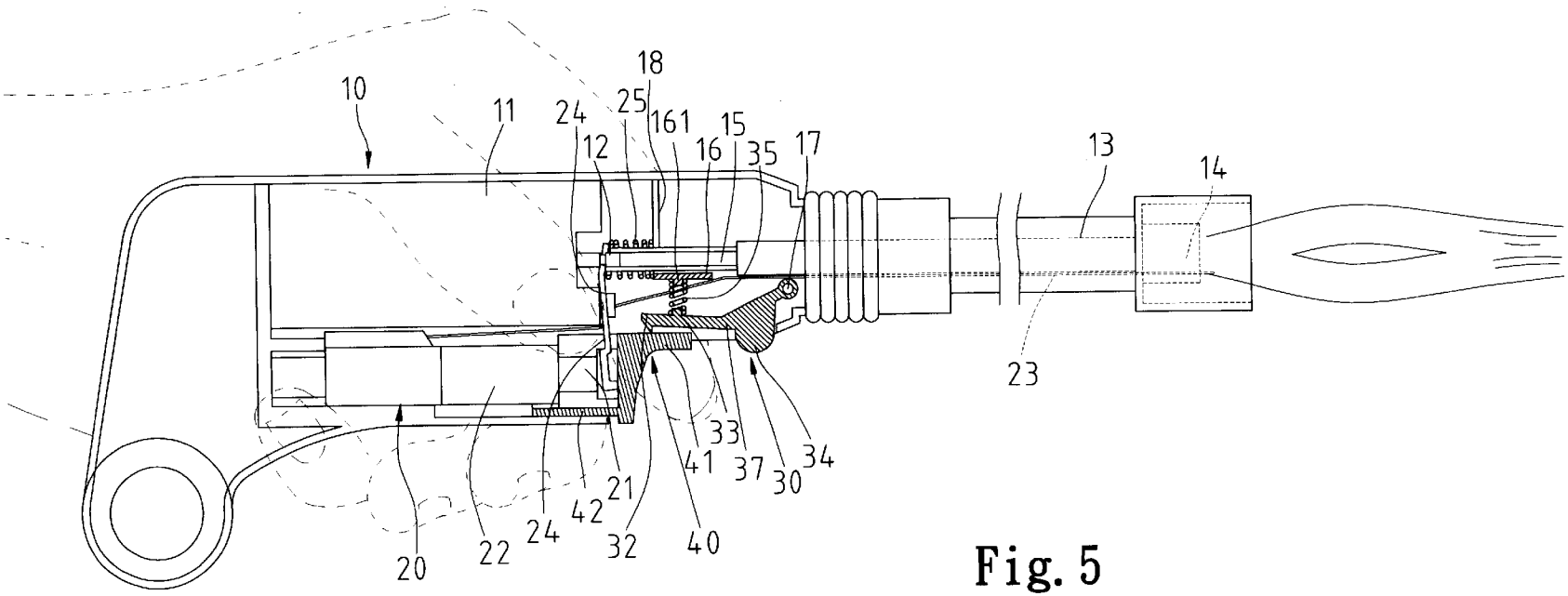
FIG. 5 is a cross-sectional view of the gas torch according to the first embodiment of the present invention.

As the button 40 is pressed, the second end of the seesaw 24 is pushed so that the first end of the seesaw 24 pulls the valve 12. Thus, fuel is allowed to vent from the tank 11. As the user continues to press the button 40, he pushes the plunger 21 toward the cylinder 22 to an extent that a voltage is produced. The voltage is transmitted to a free end of the wire 23 and the nozzle 14. Thus, an arch or spark is produced between the free end of the wire 23 and the nozzle 14 so as to ignite the fuel flowing to the nozzle 14 through the pipe 13 from the tank 11 as shown in FIG. 5.

Figure 6:
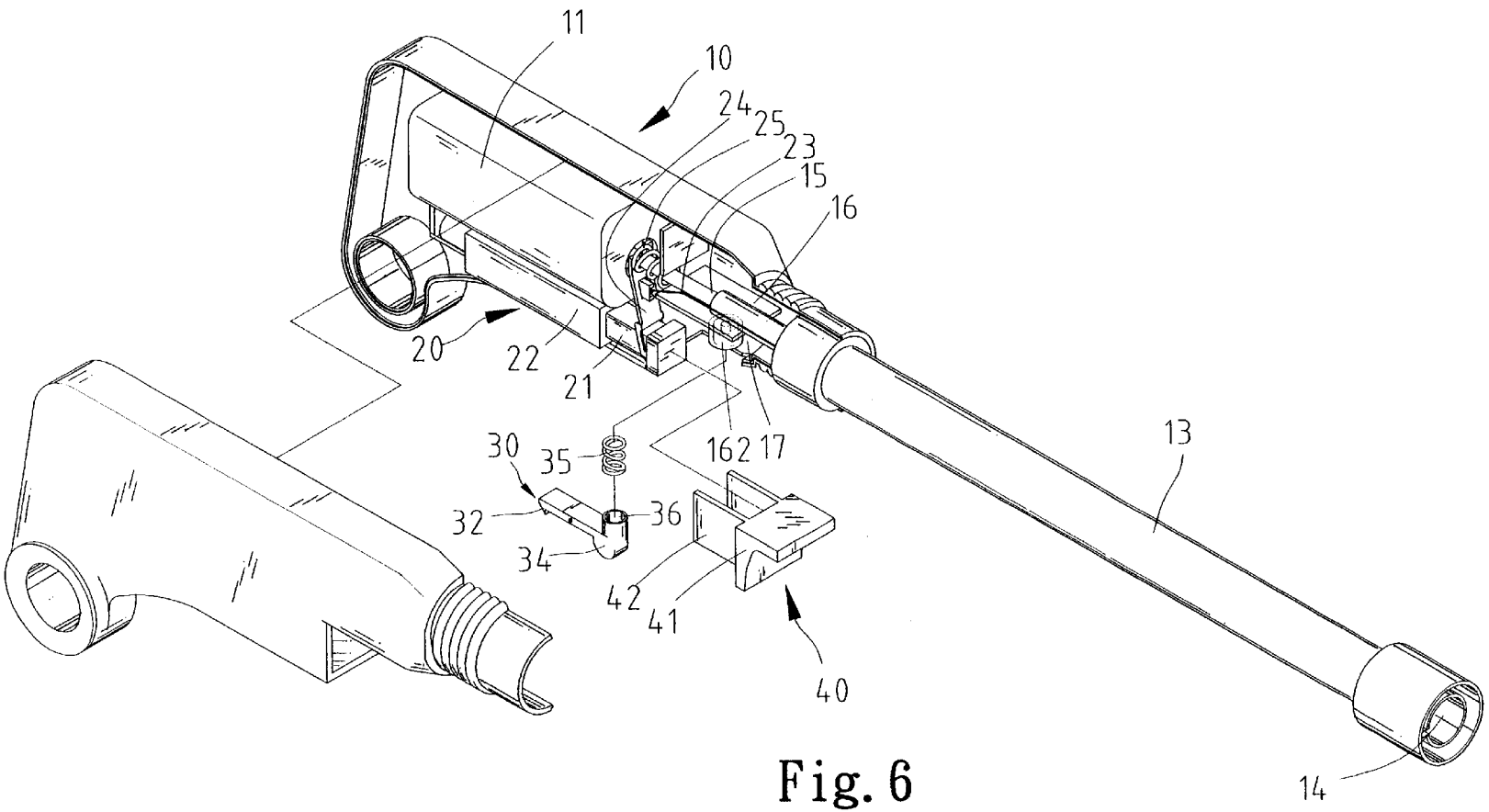
FIG. 6 is an exploded view of a gas torch according to a second embodiment of the present invention.

FIG. 6 shows a gas torch according to a second embodiment of the present invention. The second embodiment is different from the first embodiment in that a socket 162 is used instead of the boss 161 and that a socket 36 is used instead of the boss 33. The socket 162 receives an end of the spring 35 and the socket 36 receives an opposite end of the spring 35.

The present invention has been described through detailed illustration of some embodiments. Those skilled in the art can derive many variations from the embodiments without departing from the scope of the present invention. Therefore, the embodiments shall not limit the scope of the present invention. The scope of the present invention is defined in the attached claims.

What is claimed is:

1. A igniter including:

a shell;

a generator including a cylinder received in the shell and a plunger extending from the cylinder and being movable toward the cylinder in order to generate a voltage;

a button attached to the plunger; and a security device including a lever pivotally received in the shell and formed with a hook for hooking the button wherein the security device and the button are located that a user contacts the security device before the button during an operation of ignition.

2. The igniter according to claim 1 wherein the shell includes a pin formed on an internal face, and the lever includes an end formed with a collar in which the rod.

3. The igniter according to claim 1 wherein the lever is formed with an extension for contact with a user's finger.

4. The igniter according to claim 1 wherein the security device includes a spring compressed between the lever and a portion of the shell.

5. The igniter according to claim 4 wherein the shell includes a plate formed on an internal face for contact with the spring.

6. The igniter according to claim 5 wherein the plate includes a boss formed thereon for insertion in an end of the spring.

7. The igniter according to claim 5 wherein the plate includes a socket formed thereon for receiving an end of the spring.

8. The igniter according to claim 5 wherein the lever includes a boss formed thereon for insertion in an end of the spring.

9. The igniter according to claim 5 wherein the lever includes a socket for receiving an end of the spring.

10. A gas torch including:

a shell;

a tank received in the shell for containing fuel;

a valve mounted on the tank and movable between a closing position for keeping the fuel in the tank and an opening position for allowing the fuel to vent from the tank;

a generator including a cylinder received in the shell and a plunger extending from the cylinder and being movable toward the cylinder in order to generate a voltage;

a button connected with the valve and the plunger; and a security device including a lever pivotally received in the shell and formed with a hook for hooking the button wherein the security device and the button are located that a user contacts the security device before the button during an operation of ignition.

11. The gas torch according to claim 10 wherein the shell includes a pin formed on an internal face, and the lever includes an end formed with a collar in which the rod.

12. The gas torch according to claim 10 wherein the lever is formed with an extension for contact with a user's finger.

13. The gas torch according to claim 10 wherein the security device includes a spring compressed between the lever and a portion of the shell.

14. The gas torch according to claim 13 wherein the shell includes a plate formed on an internal face for contact with the spring.

15. The gas torch according to claim 14 wherein the plate includes a boss formed thereon for insertion in an end of the spring.

16. The gas torch according to claim 14 wherein the plate includes a socket formed thereon for receiving an end of the spring.

17.The gas torch according to claim 14 wherein the lever includes a boss formed thereon for insertion in an end of the spring.

18. The gas torch according to claim 14 wherein the lever includes a socket for receiving an end of the spring.

19. The gas torch according to claim 10 including a connector with an end connected with the valve and another end connected with the button.

20. The gas torch according to claim 19 wherein the connector is a seesaw.

* * * * *